US008448837B2

(12) United States Patent
Dambrine et al.

(10) Patent No.: US 8,448,837 B2
(45) Date of Patent: May 28, 2013

(54) METHOD FOR MANUFACTURING A ONE-PIECE ANNULAR METAL PART HAVING A REINFORCING INSERT OF COMPOSITE MATERIAL

(75) Inventors: Bruno Jacques Gerard Dambrine, Le Chatelet en Brie (FR); Thierry Godon, Sevran (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 13/346,014

(22) Filed: Jan. 9, 2012

(65) Prior Publication Data

US 2012/0175047 A1 Jul. 12, 2012

(30) Foreign Application Priority Data

Jan. 10, 2011 (FR) ..... 11 50194

(51) Int. Cl.
*B23K 31/02* (2006.01)

(52) U.S. Cl.
USPC ..... 228/121; 228/235.1; 29/889.1

(58) Field of Classification Search
None
See application file for complete search history.

(56) References Cited

U.S. PATENT DOCUMENTS

| | | | | |
|---|---|---|---|---|
| 3,828,417 | A | 8/1974 | Divecha | |
| 3,966,523 | A * | 6/1976 | Jakobsen et al. | 156/169 |
| 4,732,314 | A * | 3/1988 | Sakamoto | 228/190 |
| 4,867,644 | A * | 9/1989 | Wright et al. | 416/230 |
| 5,184,769 | A * | 2/1993 | Moracz et al. | 228/121 |
| 5,495,979 | A * | 3/1996 | Sastri et al. | 228/124.1 |
| 5,579,532 | A * | 11/1996 | Edd | 419/2 |
| 5,933,703 | A * | 8/1999 | Robertson | 428/549 |
| 6,122,884 | A * | 9/2000 | Talwar | 52/838 |
| 6,658,715 | B1 | 12/2003 | Podesta | |
| 7,334,999 | B2 * | 2/2008 | Aumont et al. | 416/248 |
| 2002/0088599 | A1 * | 7/2002 | Davis et al. | 164/97 |
| 2003/0029904 | A1 | 2/2003 | Pursell | |
| 2005/0103827 | A1 * | 5/2005 | Twigg | 228/194 |
| 2005/0166386 | A1 * | 8/2005 | Twigg | 29/458 |
| 2007/0051455 | A1 | 3/2007 | Franchet et al. | |
| 2007/0271784 | A1 * | 11/2007 | Fabre | 29/889.2 |
| 2007/0274832 | A1 * | 11/2007 | Andrees et al. | 416/185 |
| 2008/0206048 | A1 | 8/2008 | Coupe et al. | |

(Continued)

FOREIGN PATENT DOCUMENTS

| | | |
|---|---|---|
| EP | 1 961 923 A2 | 8/2008 |
| FR | 2 886 290 A1 | 12/2006 |

(Continued)

OTHER PUBLICATIONS

French Preliminary Search Report and Written Opinion issued Aug. 11, 2011, in French 1150194, filed Jan. 10, 2011 (with English Translation of Categories of Cited Documents).

*Primary Examiner* — Kiley Stoner
(74) *Attorney, Agent, or Firm* — Oblon, Spivak, McClelland, Maier & Neustadt, L.L.P.

(57) ABSTRACT

A method for manufacturing a one-piece annular metal part having a reinforcing insert of composite material includes forming a blank of the part by superimposing, around a rotating cylindrical mandrel, layers of metal wire and layers of coated fiber, the layers of coated composite fiber being arranged in the blank according to the positioning of the insert in the part; placing the blank in a receiving tool, and applying a hot isostatic pressing treatment to the blank; and extracting the treated blank from the receiving tool and, as required, machining the treated blank to obtain the one-piece annular metal part having a reinforcing insert.

11 Claims, 3 Drawing Sheets

U.S. PATENT DOCUMENTS

| | | | | |
|---|---|---|---|---|
| 2010/0263194 | A1* | 10/2010 | Morrison et al. | 29/525.04 |
| 2011/0005060 | A1* | 1/2011 | Masson et al. | 29/592 |
| 2011/0027119 | A1* | 2/2011 | Masson | 419/6 |
| 2011/0240204 | A1* | 10/2011 | Clark | 156/74 |
| 2012/0037602 | A1* | 2/2012 | Doorbar | 219/121.14 |
| 2012/0234431 | A1* | 9/2012 | Franchet et al. | 140/93 R |

FOREIGN PATENT DOCUMENTS

| | | | |
|---|---|---|---|
| JP | 09-287038 | A * | 11/1997 |
| JP | 2000-015424 | A * | 1/2000 |
| WO | WO 2004/018726 | A * | 3/2004 |

* cited by examiner

METHOD FOR MANUFACTURING A ONE-PIECE ANNULAR METAL PART HAVING A REINFORCING INSERT OF COMPOSITE MATERIAL

BACKGROUND OF THE INVENTION

The present invention relates to a method for manufacturing a one-piece annular metal part having a reinforcing insert of composite material.

PRIOR ART

It is known that, in particular in the field of aeronautics, it is a constant objective to optimize the strength of the parts for minimal weight and size. Some parts may now comprise an insert of composite material having a metal matrix, and the part may also be monolithic. Such a composite material comprises a matrix of metal alloy, for example an alloy of titanium Ti, within which the fibers extend, for example ceramic fibers of silicon carbide SiC. Such fibers have a tensile strength far greater than that of titanium (typically 4000 MPa compared to 1000 MPa). Hence the fibers absorb the forces, and the metal alloy matrix performs the function of bonding with the rest of the part, and also of protecting and isolating the fibers, which must not be in contact with one another. Furthermore, ceramic fibers have abrasion resistance, but must necessarily be reinforced by metal.

These composite materials are used, for example, in the manufacture of disks or rings having one-piece blades for a rotor of a compressor or turbomachine turbine, also designated by the abbreviation DAM or ANAM.

To obtain such a reinforcing insert of composite material, wires called "coated wires" are first formed, comprising a metal-coated ceramic fiber. The metal imparts to the wire the elasticity and flexibility required for its handling. Preferably, a very fine carbon or tungsten wire extends at the center of the fiber, along its axis, said carbon wire is coated with silicon carbide, while a fine layer of carbon is provided at the fiber/metal interface, to act as a diffusion barrier and buffer during the differential thermal relaxation which occurs during the cooling of the liquid metal deposited on the fiber.

To manufacture a one-piece annular part such as a bladed rotor disk, before inserting a composite reinforcing insert, a forging process (see FR 2 901 305) is known, entailing a plurality of forging operations in a metal mass (slug) to obtain a preshaped part, qualified as pre-machined, followed by a plurality of machining operations to produce in particular the blades and their common platform. Such a method finally yields a structurally and functionally satisfactory part, but at particularly high production cost and with considerable weight.

To overcome in particular the drawbacks of the above method, manufacturing processes are employed using the abovementioned composite materials to be integrated in metal containers (see for example FR 2 886 290 and 2 901 497 filed in the name of the Applicant). For this purpose, a known method for manufacturing a turbine engine rotor disk having a reinforcing insert of composite material (FR 2 901 497) consists in:

- defining a metal container comprising two coaxially superimposed annular blocks, outer and inner, respectively, and two lateral annular flanges, said blocks and said flanges together bounding an annular cavity,
- positioning an abovementioned insert in the cavity,
- subjecting the assembly thus formed to a hot isostatic pressing operation, to form a one-piece blank, and
- machining the abovementioned rotor disk from said blank.

Although this method serves to obtain an annular part having a composite insert, thereby improving the mechanical properties of the part and reducing its weight, it is finally necessary to machine the container to produce the complete disk, that is to say, its portion forming a rim or a ring and its peripheral portion with blades and platform, thereby incurring high costs, specific tooling stations, and commensurately longer production time.

Furthermore, the initial production of the container from blocks and annular flanges also demands repeated lengthy and costly operations, because one container is required for each one-piece bladed disk to be produced.

SUMMARY OF THE INVENTION

It is the object of the present invention to overcome these drawbacks and it relates to a method for manufacturing a one-piece annular metal part such as, in the preferred application, a bladed disk or a ring of a turbine engine rotor, incorporating at least one reinforcing insert issuing from at least one metal-coated fiber of composite material (ceramic or similar).

For this purpose, the inventive method of the abovementioned type is noteworthy in that it consists in:

- forming a blank of said part by superimposing, around a rotating cylindrical mandrel, layers of metal wire and layers of coated fiber, said layers of coated fiber being arranged in the blank according to the positioning of said insert in the part,
- placing the blank in a receiving tool, and applying a hot isostatic pressing treatment to the blank, and
- extracting the treated blank from the receiving tool and, as required, machining the treated blank to obtain said one-piece annular metal part having a reinforcing insert.

Thus, thanks to the invention, a one-piece annular part is obtained at minimum cost, because it consists initially and entirely of windings of metal wire and composite fiber, without resorting, in the preferred application, to lengthy and costly block and flange design and manufacturing operations, followed by final machining operations on the entire part obtained. According to the invention, after the passage in the receiving and treatment tool which caused the flow of the metal wire and of the metal coating of the fibers, a homogeneous metal part is formed directly constituting the container of the prior art without the abovementioned drawbacks, only a machining operation on the blades in the peripheral portion of the annular blank being mainly performed to obtain the part.

Preferably, the metal wire and the composite fiber are cold wound at ambient temperature, which does not require a complex installation for implementing the steps of the method concerned. And advantageously, the metal wire used is obtained, for example, by wire drawing and is made from the same metal as that of the coated fiber. However, any wire obtained otherwise than by wire drawing could obviously be suitable. In the present context, metal wire equally means a single continuous wire throughout the method and a plurality of wires positioned end to end. The metal wire may also be individual or in the form of a layer or strip of a plurality of parallel or interlaced wires, a wire rope, a unidirectional wire fabric, etc., while remaining within the scope of the invention.

Furthermore, the metal wire and the composite fiber are wound substantially perpendicular to the axis of the rotating cylindrical mandrel, in order to orientate the latter in the correct direction with regard to the centrifugal force subsequently exerted on the disk in operation.

In particular, the layers of composite fiber are arranged on a partial median area of the extent of the metal wire wound around the cylindrical mandrel, and radially close thereto. Thus, the reinforcing insert is located at the core of the rim portion of the one-piece part obtained. Obviously, the invention is not limited to such a median positioning of the insert, which can be positioned elsewhere in the part, nor to the presence of a single insert. In fact, the part to be obtained may, if necessary, comprise a plurality of inserts having different or identical shapes and dimensions, arranged at various locations thereof, said inserts being obtained from layers of coated composite fiber arranged in the metal wire layers of the blank.

Preferably, the layers of metal wires are held together by bonding means, so as to obtain a blank that can be handled until its introduction into said tool. Thus, the annular blank comprising the metal wire layers can be removed without risk from the cylindrical mandrel, for its transfer to the treatment tool. For example, the bonding means are obtained by welding, in particular by electric tack welding, or are formed of metal sheet(s) enclosing the metal wire windings.

According to another feature, to facilitate the assembly of the wire layers in particular for high part widths (or thicknesses), two transverse flanges are arranged around the cylindrical mandrel, spaced in parallel to one another and between which the windings forming the layers of joined turns of metal wire are mounted.

Furthermore, recesses can advantageously be made in the flanges for accommodating windings of metal wire, and corresponding to changes in cross section of the annular part to be obtained. Other annular flanges can also be provided, being superimposed on the previously mounted flanges and having a different spacing or profile representative of a change in cross section or shape of the part to be obtained in accordance with the production of the blank by the metal wire. Thus, the method is not limited to a basic annular part shape, but serves to obtain various complex annular part shapes (multistage, tapered, etc.) by consecutive windings of metal wires/metal composite fibers, with substantial cost reductions by decreasing the number of operations (several parts can be manufactured simultaneously in the receiving and treatment tool, as shown below).

It is also possible to incorporate the cylindrical mandrel, the annular flanges and the blank having a metal wire and composite fiber, directly in the receiving and treatment tool.

In the preferred but nonexclusive application of the invention, the one-piece annular part has a rim portion with a reinforcing insert and a peripheral portion for advantageously, after the machining of the peripheral portion, defining a bladed rotor disk for a turbine engine.

BRIEF DESCRIPTION OF THE DRAWINGS

The figures in the appended drawing clearly show how the invention can be implemented. In these figures, identical references denote similar elements.

DESCRIPTION OF THE PREFERRED EMBODIMENTS

Figure 1:
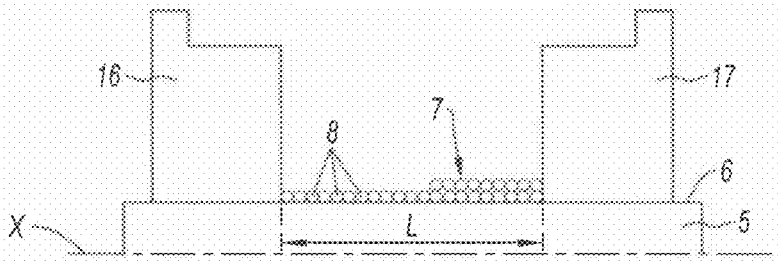
FIGS. 1, 2, 3 and 4 schematically show the main steps of the inventive method for manufacturing an annular part such as, in this example, a one-piece bladed disk having a reinforcing insert of composite material.

The object of the inventive method is to manufacture a one-piece annular metal part 1 exclusively from elongated elements in the form of wires, fibers and similar.

In the exemplary embodiment shown with regard to FIG. 5 and which is described below, the one-piece annular part 1 is intended, after the implementation of the method, to define a disk or bladed ring for a turbine engine rotor (compressor or turbine), usually comprising a rim or ring portion 2 and, around it, an outer peripheral portion 3 from which the blades are obtained after machining. The method consists in progressively shaping a blank E of the desired part 1 by the superimposition of layers of metal wires 7 and layers of composite fibers 10, for example ceramic, coated with metal and arranged in the blank E according to the position of the reinforcing insert 11 in the part.

In a first step shown schematically in FIG. 1, the method consists in using a rotating cylindrical mandrel 5 having a longitudinal axis X and in winding, around the lateral surface 6 thereof, at least one metal wire 7. Considering the application of the part 1 in the field of aeronautics, the metal wire 7 is made from type TA6V or 6242 titanium alloy providing thermomechanical strength and lightness, and is obtained in particular by wire drawing in order to obtain same in the form of a coil or reel from which the wire is drawn (instead of coiling, the wire layers can also be deposited, like the composite fibers, in the form of sheets, fabrics, etc.). Dimensionally, its diameter depends on the part to be obtained and may, for example, be about 0.2 millimeter, so that the decrease in volume following the hot isostatic pressing treatment, as shown below, is minimal, the voids between the joined turns superimposed in layers around the mandrel being more or less low according to the square or hexagonal stacking of the turns.

This drawn metal wire issuing from a coil, not shown, is brought, in a direction substantially perpendicular to the axis X, around the lateral surface 6 of the cylindrical mandrel 5 along a predefined extent or length corresponding to the width (or thickness) L to be obtained, after manufacture, for the rim portion 2 of the disk, thereby forming a plurality of coiled joined turns 8, and on a plurality of predefined superimposed layers, in order progressively to first produce the rim portion 2.

Figure 2:
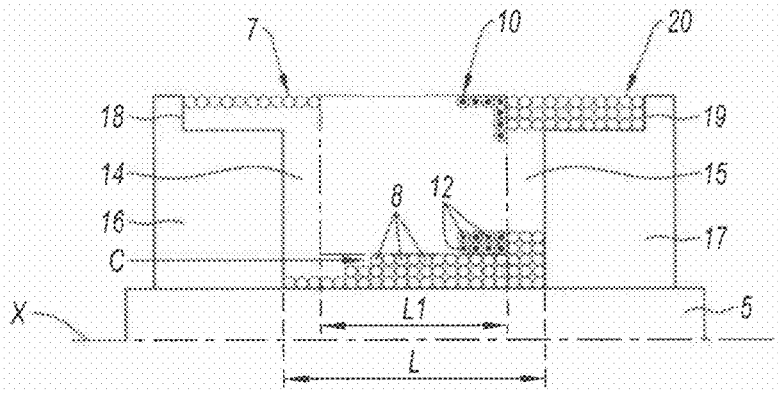

Then, when the desired thickness of the layers of turns 8 is reached, the metal-coated composite fiber 10 is wound on the visible outer layer C of the metal wire 7, as shown in FIG. 2.

This fiber 10 is continuous and also issues from one or a plurality of coils with a fiber orientation substantially perpendicular to the axis X of the cylindrical mandrel 5. As a reminder, the composite fiber 10, which is intended to form the reinforcing insert 11 of the annular part, has a silicon carbide (SiC) core in this example, coated with a metal matrix made from the same material as the wire, in particular the drawn wire. Dimensionally, the diameter of the composite fiber is about 0.25 to 0.30 millimeter with a core diameter of about 0.15 millimeter. Obviously, these figures are only given as examples and could be different according to the type of part to be produced, as well as the matrix material. The metal-coated composite fiber 10, shown here as individual, could, in the same way as the wire, be different, for example in the form of a wire rope, sheet, strip or fabric including a plurality of unidirectional (parallel) fibers.

FIG. 2 shows that the winding in coiled joined turns 12 of the metal composite fiber 10 extends along a distance L1 in the mid-portion of the visible layer C of the drawn metal wire 7, leaving the two dimensionally identical side end zones 14, 15 free. For example, the extent L1 of the layer of joined turns 12 of the composite fiber 10 is about 20% to 70% of the extent L of the drawn metal wire. The winding of the composite fiber 10 continues so as to form the coiled turns 12 of n superimposed and equal layers until the predefined height H is reached, in order to obtain, in the blank E, the future position in the part of the rectangular-section reinforcing insert 11, as shown in FIG. 3.

In particular, concomitant with the winding of the fiber 10 (or layer of fibers 10) of composite material, the winding of the metal wire 7 continues, on either side of the composite fiber thus coiled, respectively. For example, the metal wire 7 having served for the winding of the turns 8 of the first layers, continues to be used to "mount" the layers of coiled joined turns 8 on one, 14, of the free side zones, and another drawn metal wire, identical to the previous one, is then used for winding the layers of coiled joined turns 8 for the other free side zone 15. This procedure is obviously nonlimiting. Furthermore, the coiling of the fiber forming the insert, followed by the coilings of the side zones of metal wire, can also be carried out one after the other, or vice versa, while remaining within the scope of the invention. Once the side zones 14, 15 are filled by the windings, one of the metal wires then continues to be wound in joined turns 8, over the entire width L, thereby covering the reinforcing insert 11 produced, and over the number of layers required.

Figure 3:
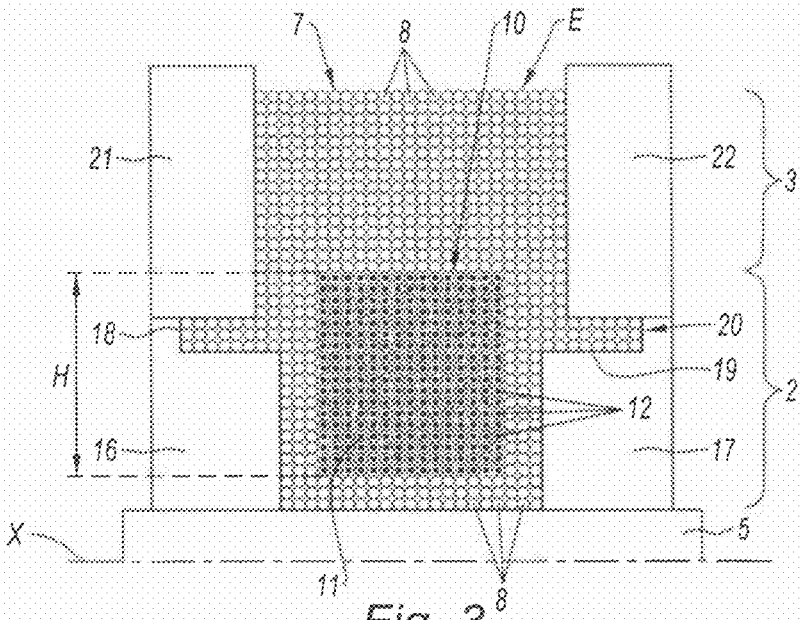

Furthermore, as shown in FIGS. 1 to 3, in order to obtain changes in cross section according to the geometric shape of the desired part and to facilitate the placing of the superimposed layers to form coiled joined turns, two annular flanges spaced and parallel to one another, 16, 17 are mounted transversally around said cylindrical mandrel 5. The layers of joined turns 8 of metal wire 7 are wound between these flanges. The spacing between the transverse annular flanges 16, 17 is determined so as to obtain the width L of the part 1 at this level from the metal wire wound between the flanges and in which the wound fiber of composite material 10 subsequently forming the reinforcing insert 11 is progressively embedded.

These flanges 16, 17 may in particular be made from metal and/or plastic and we may observe, in the example in FIG. 3, that they have mutually opposed peripheral annular recesses 18, 19 for the placement of windings of superimposed layers of joined turns 8 from drawn metal wire 7 and for increasing the width of the extent L of the windings. In the present case, the latter are intended to form the platform 20 of the rim portion 2 of the bladed disk.

Once the windings are completed and another change in cross section is to be provided on the part to be manufactured (in the example, decrease in width), two other outer annular flanges 21, 22, respectively, are arranged coaxially around the outer periphery of the transverse flanges 16, 17, as shown in FIG. 3. The spacing between the flanges 21, 22 corresponds to the desired width to be obtained at this position of the blank E and is slightly higher than the previous spacing L. The outer annular flanges 21, 22 are held on the transverse and therefore inner flanges 16, 17 by any suitable bonding means, not shown in this figure.

The windings of layers of joined turns 8 are then positioned between the two outer annular flanges 21, 22, while the mandrel is rotated and the metal wire 7 is moved until the predefined radial dimension shown in FIG. 3 is obtained.

The drawn metal wire 7 and metal-coated composite fiber 10 are cold wound at ambient temperature, facilitating their placement and at minimum cost. Because their circumferential winding is perpendicular to the cylindrical mandrel, the wire and the fiber are oriented in the proper direction with regard to the centrifugal force exerted subsequently on the disk.

Obviously, depending on the shape of the part to be manufactured, other pairs of transverse flanges can be mounted in succession in order to form a blank E with staged profiles, with spacings which decrease and/or increase, and/or tapered profiles, expanding in accordance with the windings. Thus, the method is not limited to a specific shape of annular part and is suitable for manufacturing annular parts of complex shape.

Figure 3A:
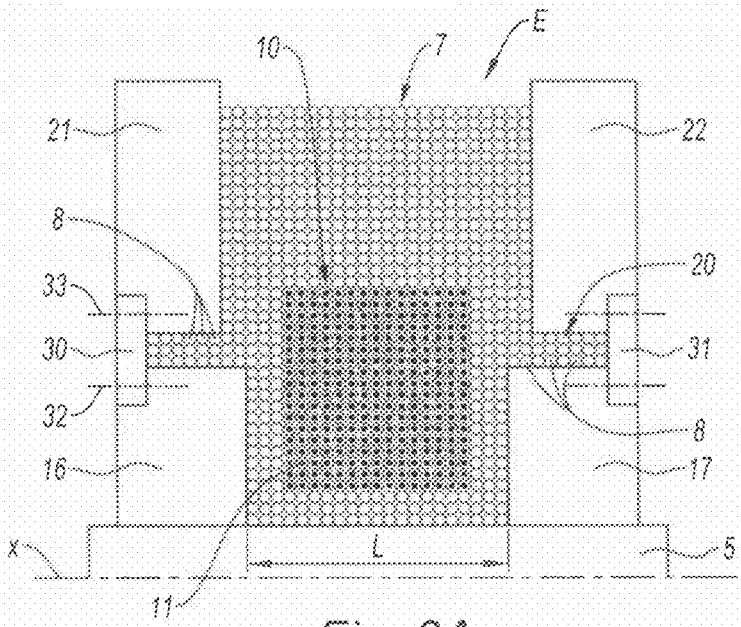
FIG. 3A shows a different arrangement of the transverse flanges during the assembly of the metal wire layers.

In an alternative arrangement of flanges shown with regard to FIG. 3A, to make changes in cross section of the blank (corresponding, in the example described, to the platform 20 to be produced, that is to say, an increase in width L of the blank), the windings of joined turns 8 forming the superimposed layers of metal wire continue to be mounted on the outer lateral periphery of the flanges 16, 17 until they contact the flat rings 30, 31 added on transversally, by fastening elements 32 (for example screws), against the respective flanges 16, 17 and projecting radially from the periphery thereof. The recesses are no longer integrated with the flanges 16, 17 but are formed by the lateral periphery thereof and the flat rings added on. And this is done over the desired coiling width of the platform to be obtained.

Then, at the next change in cross section, like a decrease in width in the example, after the placement of the suitable number of superimposed layers of metal wire 7, corresponding to the desired height of the platform, the additional outer annular flanges 21, 22 are fastened to the rings 30, 31 via the fastening elements 33 (for example screws), with the spacing between said flanges corresponding to the desired width, as for the embodiment in FIG. 3. And the assembly of the blank continues. This procedure can therefore be followed at every change in cross section encountered (increase/decrease of the width of the blank as a function of the diametrical change thereof). The changes in cross section are not necessarily symmetrical and at the same height (part thickness).

When the wire and fiber winding steps are completed, according to a first alternative, the transverse flanges 16, 17, 21, 22 (and the flat rings) are removed, and the annular blank E is extracted from the cylindrical mandrel 5, said blank being produced exclusively from the drawn metal wire 7 and the coated composite fiber 10.

Figure 4:
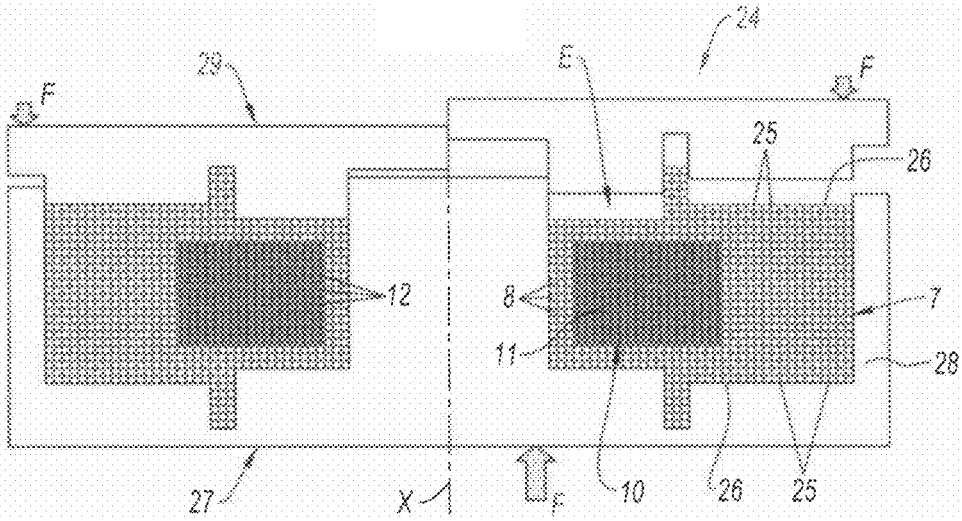
Figure 4A:
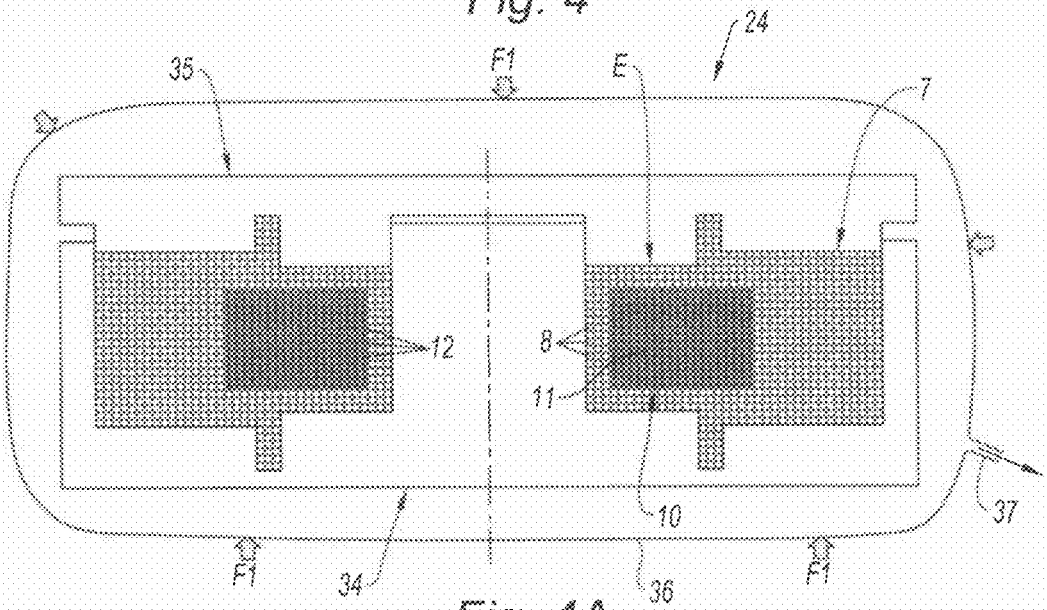
FIG. 4A is an alternative embodiment of the blank receiving and treatment tool.

The blank E is then transferred to a suitable receiving and treatment tool, such as a hot isostatic pressing (HIP) tool 24, where the step of plastic deformation and flow of the metal wire with the metal coating of the composite fiber takes place, followed by their diffusion welding in an isothermal press under vacuum or in an autoclave (the choice depending in particular on the number of parts to be produced), as shown schematically and respectively in FIGS. 4 and 4A.

However, before its transfer, a step of bonding or holding the windings of metal wire 7 is carried out to ensure overall cohesion of the superimposed layers of turns during the transfer to the pressing station and to avert the risk of collapse of the blank. For this purpose, a welding step can be carried out, for example tack welding in particular, symbolized in places as 25 in FIG. 4, between the windings of the visible turns on the transverse faces 26 of the blank E, and even at the outer and inner periphery thereof. Instead of welding, a strip or foil, not shown, can be positioned, surrounding the blank and thereby holding the visible windings, welded or not, in place.

The latter, if made from a compatible material, can then participate in the manufacture of the part.

After the transfer and placement of the blank E in the vacuum press tool 24, FIG. 4, more particularly in a cylindrical, open receptacle 27 of the press, whereof the receiving volume, defined by its transverse, lateral and central walls 28, corresponds to that of the part to be obtained, the receptacle is closed by the lid 29 of the press, which has a shape complementary to the opening of the receptacle and to the transverse face 26 of the blank opposite.

Under the action of the pressure applied by the press plates symbolized by the arrows F, and at a suitable elevated temperature, the identical metal of the drawn wire 7 and of the coating of the composite fiber 10 becomes pasty, eliminating all the voids between the pressed turns 8, 12 and finally densifying the part that is being obtained by the axial movement of the lid (shown in two positions in FIG. 4) with regard to the receptacle, without acting on the silicon carbide matrices of the fibers 10. Thus, after stopping the HIP treatment, cooling and removing the tool from the receptacle, the annular part obtained 1 is a one-piece part, homogeneous and made to the desired dimensions, having in its core the reinforcing insert 11 formed of the cores of the fibers, as shown in FIG. 5.

In the alternative embodiment shown in FIG. 4A of the tool 24 in the autoclave, the receptacle 34 and the lid 35 with blank E inside are placed in a deformable mild steel bag 36 which is then introduced into the autoclave of the tool 24. For example, said autoclave is raised to an isostatic pressure of 1000 bar and heated to a temperature of 940° C. (for TA6V), so that the entire bag 36 is deformed, arrows F1, as it shrinks by the removal of the air expelled via the hole 37 and is pressed against the receptacle 34 and the lid 35 (this step is generally carried out before introduction into the autoclave) which, in their turn, compress the wire and fiber windings under a uniform pressure until their constituent metal flows (diffusion welding), as described above. Advantageously, several bags 36 can thus be introduced into the autoclave of the tool 24 to produce the parts simultaneously, thereby reducing production costs.

Figure 5:
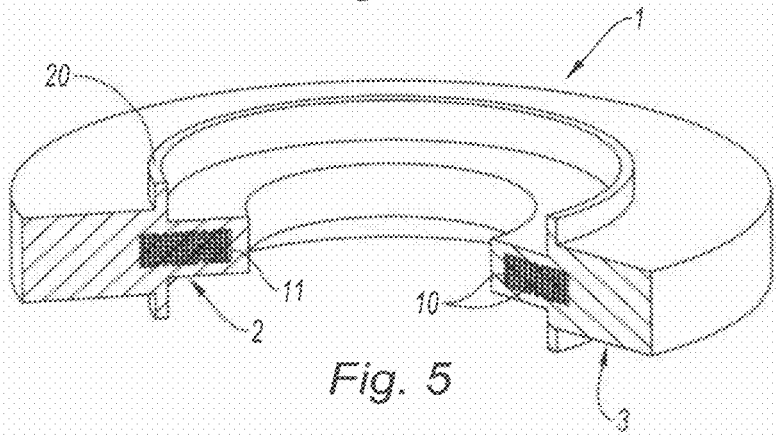
FIG. 5 shows a partial perspective view of the one-piece bladed disk obtained after implementation of the method.

The one-piece bladed ring 1, produced exclusively from the windings of drawn metal wire and metal composite fiber, and obtained by HIP regardless of the tool employed, is shown in FIG. 5. Subsequently, the blades of the peripheral portion 3 are made by the usual machining.

According to a second alternative, not shown, the flanges and the cylindrical mandrel, within which the drawn wire and composite fiber windings are positioned, are incorporated in the treatment tool 24 in the vacuum press or the autoclave, thereby forming an integral part of the tool. Under the action of the pressure applied and the temperature softening the metal, the flanges move towards each other (the flanges on at least one side being mobile) until the final part is obtained, as in the first alternative.

In the context of the present invention, for their manufacture and as nonlimiting examples, inserts and/or preforms can be used, based on coated wires of SiC—Ti, SiC—SIC, SiC—Al, SiC—B or of preformed or woven metal wires.

Although the one-piece annular part described above is provided with a single reinforcing insert, it could include other reinforcing inserts at specific locations thereof, with different shapes.

Figure 6A:
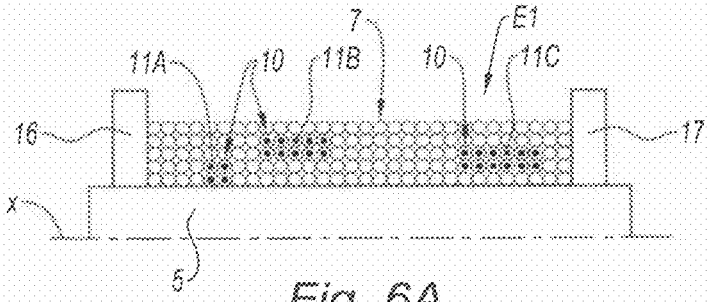
FIGS. 6A, 6B and 6C schematically and partially show various arrangements and shapes of reinforcing inserts.

For example, as shown schematically with regard to FIG. 6A, around the cylindrical mandrel 5 and between the two flanges 16, 17, a blank E1 of a desired cylindrical part is provided, which includes the annular reinforcing inserts 11A, 11B and 11C to be produced from coated composite fiber 10, at three distinct locations of the blank. The composite fiber winding layers, which may issue from the same feed coil, are mounted, at selected locations, between the winding layers of drawn metal wire 7. The annular inserts 11A, 11B and 11C that will be formed by these composite fiber layers 10 have different cross sections (square and rectangular) in this example, and any other cross section can obviously be considered.

Figure 6B:
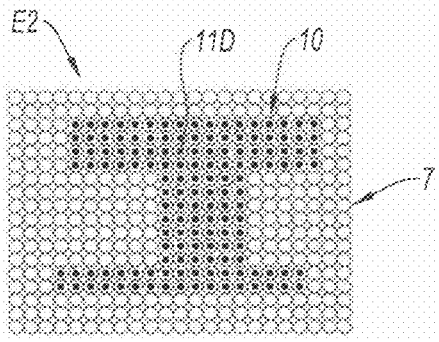
Figure 6C:
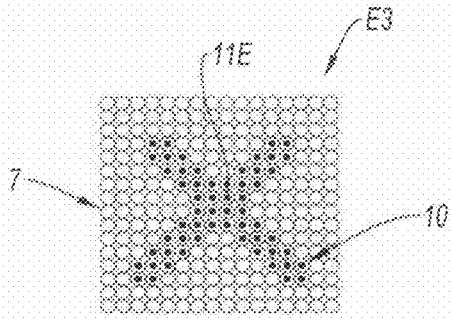

In the blanks E2 and E3 shown schematically with regard to FIGS. 6B and 6C respectively, the reinforcing inserts 11D and 11E obtained by the winding layers of coated composite fiber 10, have a substantially H- or X-shaped cross section with undercut. The geometry of the reinforcing insert to be produced in the one-piece annular metal part is therefore not restricted to the usual shapes.

It is the object of these examples to show that the location, number and shape of the reinforcing inserts issuing from the coated composite fibers are freely selected in accordance with the one-piece annular parts to be manufactured, and that the inventive method is not limited to those shown.

Furthermore, for information, the windings in layers of metal wire and metal composite fiber, which determine their bulking, may have a square stacking, that is to say, that the wire or fiber turns between two superimposed layers are arranged upon one another with a single contact, or a hexagonal stacking, that is to say, that the wire or fiber turns between two superimposed layers are offset, with two contacts (the wire turn of one layer being in contact with two joined turns of an upper or lower layer). The latter stack allows a lower bulking ratio, with fewer voids being provided between the windings.

The invention claimed is:

1. A method for manufacturing a one-piece annular metal part incorporating at least one reinforcing insert made from at least one metal-coated fiber of composite material, comprising:

forming a blank of said part by superimposing, around a rotating cylindrical mandrel, layers of metal wire and layers of coated fiber, said layers of coated composite fiber being arranged in the blank according to the positioning of said insert in the part;

placing the blank in a receiving tool;

applying a hot isostatic pressing treatment to the blank; and extracting the treated blank from the receiving tool and, as required, machining the treated blank to obtain said one-piece annular metal part having a reinforcing insert, wherein two transverse flanges are arranged on said cylindrical mandrel, spaced in parallel to one another and between which the windings forming the layers of joined turns of metal wire are mounted.

2. The method as claimed in claim 1, wherein the metal wire and the composite fiber are cold wound at ambient temperature, and the metal wire used is obtained by wire drawing and is made from the same metal as that of the coated fiber.

3. The method as claimed in claim 1, wherein the metal wire and the composite fiber are wound substantially perpendicular to the axis of the rotating cylindrical mandrel.

4. The method as claimed in claim 1, wherein the layers of composite fiber are arranged on a partial median area of an extent of the metal wire wound around the cylindrical mandrel.

5. The method as claimed in claim 1, wherein the at least one layer of metal wires are held together by bonding means, so as to obtain a blank that can be handled until its introduction into said receiving tool.

6. A method for manufacturing a one-piece annular metal part, incorporating at least one reinforcing insert issuing from at least one metal-coated fiber of composite material, comprising:

forming a bland (E) of said part by superimposing, around a rotating cylindrical mandrel, layers of metal wire and layers of coated fiber, said layers of coated composite fiber being arranged in the blank according to the positioning of said insert in the part;

placing the blank in a receiving tool, and applying a hot isostatic pressuring treatment to the blank; and extracting the treated blank from the receiving tool and, as required, machining the treated blank to obtain said one-piece annular metal part having a reinforcing insert, wherein two transverse flanges are arranged on said cylindrical mandrel, spaced in parallel to one another and between which the windings forming the layer of joined turns of metal wire are mounted, and wherein recesses are made in the flanges, for accommodating windings of metal wire, and corresponding to changes in cross section of the annular part to be obtained.

7. A method for manufacturing a one-piece annular metal part, incorporating at least one reinforcing insert issuing from at least one metal-coated fiber of composite material, comprising:

forming a blank of said part by superimposing, around a rotating cylindrical mandrel, layers of metal wire and layers of coated fiber, said layers of coated composite fiber being arranged in the blank according to the positioning of said insert in the part;

placing the blank in a receiving tool, and applying a hot isostatic pressing treatment to the blank; and extracting the treated blank from the receiving tool and, as required, matching the treated blank to obtain said one-piece annular metal part having a reinforcing inset, wherein two transverse flanges are arranged on said cylindrical mandrel, spaced in parallel to one another and between which the windings forming the layer of joined tunes of metal wire are mounted, and wherein pairs of annular flanges are provided, being superimposed on the previously mounted flanges, at each change in cross section of the part to be obtained in accordance with production of the part by the metal wire.

8. The method as claimed in claim 1, wherein the cylindrical mandrel, the annular flanges and the blank having a metal wire and composite fiber, are incorporated in the receiving tool.

9. The method as claimed in claim 1, wherein the receiving tool includes a cylindrical open receptacle presenting a receiving volume, and the receptacle is closed by a lid with a shape complementary to an opening of the receptacle and a transverse face of the blank.

10. The method as claimed in claim 9, wherein the hot isostatic pressing treatment is applied under pressure applied by press plated at an elevated temperature.

11. The method as claimed in claim 9, wherein the hot isostatic pressing treatment is applied by placing the receiving tool and lid in a bag, placing the bag in an autoclave, and raising a pressure and temperature in the autoclave to deform the bag.

* * * * *

UNITED STATES PATENT AND TRADEMARK OFFICE

CERTIFICATE OF CORRECTION

PATENT NO. : 8,448,837 B2
APPLICATION NO. : 13/346014
DATED : May 28, 2013
INVENTOR(S) : Bruno Jacques Gerard Dambrine et al.

It is certified that error appears in the above-identified patent and that said Letters Patent is hereby corrected as shown below:

In the Claims:

Column 9, line 5, change "forming a bland" to --forming a blank--;

Column 9, line 11, change "isostatic pressuring" to --isostatic pressing--;

Column 10, line 9, change "tunes of metal" to --turns of metal--; and

Column 10, line 25, change "by press plated" to --by press plates--.

Signed and Sealed this
Tenth Day of September, 2013

Teresa Stanek Rea
*Acting Director of the United States Patent and Trademark Office*